US008628169B2

(12) United States Patent
Steuer et al.

(10) Patent No.: US 8,628,169 B2
(45) Date of Patent: Jan. 14, 2014

(54) PRINTER CLEANING METHOD

(75) Inventors: Daniel Steuer, Itasca, IL (US); George Hollis, Witcham (GB); Michael Kozee, Wheaton, IL (US); Wolfgang Neumeier, Island Lake, IL (US); Chris O'Toole, St. Peters, MO (US)

(73) Assignee: Videojet Technologies Inc., Wood Dale, IL (US)

( * ) Notice: Subject to any disclaimer, the term of this patent is extended or adjusted under 35 U.S.C. 154(b) by 0 days.

(21) Appl. No.: 13/576,444

(22) PCT Filed: Feb. 11, 2011

(86) PCT No.: PCT/US2011/024481

§ 371 (c)(1),
(2), (4) Date: Aug. 1, 2012

(87) PCT Pub. No.: WO2011/100517

PCT Pub. Date: Aug. 18, 2011

(65) Prior Publication Data

US 2012/0299993 A1 Nov. 29, 2012

Related U.S. Application Data

(60) Provisional application No. 61/304,431, filed on Feb. 13, 2010.

(51) Int. Cl.
*B41J 2/165* (2006.01)
*B41J 2/02* (2006.01)

(52) U.S. Cl.
CPC ..... *B41J 2/16552* (2013.01); *B41J 2/02* (2013.01)
USPC ..... 347/28; 347/73

(58) Field of Classification Search
CPC ..... B41J 2/16552
See application file for complete search history.

(56) References Cited

U.S. PATENT DOCUMENTS 5,412,411 A * 5/1995 Anderson ..... 347/28
5,790,147 A * 8/1998 Hensel ..... 347/28

(Continued)

FOREIGN PATENT DOCUMENTS

JP 2002127439 A * 5/2002
JP 2004358667 A * 12/2004

(Continued)

OTHER PUBLICATIONS

Machine generated English translation of JP 2002127439A to Osawa, Shigeru, "Capping Method for Ink Jet Head," generated via http://www19.ipdl.inpit.go.jp/PA1/cgi-bin/PA1INDEX on Aug. 20, 2013; 2 pp.*

*Primary Examiner* — Shelby Fidler
(74) *Attorney, Agent, or Firm* — Joseph A. Yosick

(57) ABSTRACT

A method of cleaning a print head assembly comprising a print head and a cover includes removing the cover from the print head assembly. A cleaning unit includes a fluid chamber, a fluid intake port, and a fluid exit port. The cleaning unit is attached to the print head such that the fluid chamber surrounds a portion of the print head. A solvent is introduced into the fluid chamber to contact the print head. The solvent is allowed to clean the print head. The solvent is removed from the chamber.

14 Claims, 7 Drawing Sheets

(56) References Cited

U.S. PATENT DOCUMENTS

| | | | | |
|---|---|---|---|---|
| 6,247,781 | B1 * | 6/2001 | Blum | 347/29 |
| 6,637,871 | B1 | 10/2003 | Martin et al. | |
| 6,660,103 | B1 * | 12/2003 | Johnston et al. | 134/30 |
| 7,033,003 | B2 | 4/2006 | Martin et al. | |
| 7,128,410 | B2 | 10/2006 | Levin et al. | |
| 2003/0011656 | A1 * | 1/2003 | Caren et al. | 347/28 |
| 2003/0058301 | A1 * | 3/2003 | Sekiya | 347/29 |
| 2003/0189614 | A1 | 10/2003 | Steinfield et al. | |
| 2005/0092204 | A1 | 5/2005 | Zhu et al. | |
| 2005/0116986 | A1 | 6/2005 | Caren et al. | |
| 2005/0206673 | A1 | 9/2005 | Levin et al. | |
| 2006/0247122 | A1 | 11/2006 | Hampden-Smith et al. | |
| 2007/0056604 | A1 * | 3/2007 | Wang et al. | 134/1 |
| 2007/0070101 | A1 * | 3/2007 | Sugahara | 347/9 |
| 2007/0252863 | A1 * | 11/2007 | Sun et al. | 347/28 |

FOREIGN PATENT DOCUMENTS

| | | | | |
|---|---|---|---|---|
| JP | 2006150937 | A | * | 6/2006 |
| JP | 2007090584 | A | * | 4/2007 |
| WO | WO 2008090164 | A2 | * | 7/2008 |

* cited by examiner

PRINTER CLEANING METHOD

CROSS REFERENCE TO RELATED APPLICATIONS

This application claims priority under 35 U.S.C. §371 from PCT Application No. PCT/US2011/024481, filed in English on Feb. 11, 2011, which claims the benefit of U.S. Provisional Application No. 61/304,431, filed Feb. 13, 2010, the disclosures of both of which are incorporated herein by reference in their entireties.

BACKGROUND

The present disclosure relates to ink jet printing and more particularly to a cleaning device to remove contaminants—i.e., ink and other debris—that accumulate during normal operation at undesirable locations on functional components of a binary array print head.

In the course of operating a binary array continuous ink jet printer, various components at or near the nozzle orifices will become contaminated with ink. Additionally, environmental conditions may also lead to the contamination of various components at or near the nozzle orifices. The current method to clean the contamination from the components is a manual operation requiring hands-on operator intervention. Procedures and work instructions can be defined for printer operators to document the steps necessary to clean the components. These steps usually involve manually rinsing the print head with a solvent wash bottle. However, these procedures not only require operator intervention, but additionally call for the operator to make subjective judgment calls regarding the cleaning time, the precise locations where cleaning fluid is applied, the volume of fluid required to clean, and the time allowed for evaporation or drying of the cleaning fluid. In production environments, particularly where the print head may limit net production throughput by stopping the production line altogether, the operator is often forced to clean and ready the print head as rapidly as is conceivable to ensure production quotas. Hence, operator variability can actually contribute to downtime when and operator fails to perform sufficient cleaning resulting in rework due to failures in the electrical components after restart or the increased frequency of head cleanings during production, i.e., by a factor of two or more.

In addition to the above reasons, there is a significant cost savings potential for end users to be able to reduce the total amount of operator time involved with running a binary array printer.

The ability to reliably and consistently clean the print head using a less arbitrary procedure with little or no user input allow longer and more consistent head cleaning cycles and increased overall production efficiency.

BRIEF SUMMARY

In one aspect, a method of cleaning a print head assembly comprising a print head and a cover includes removing the cover from the print head assembly. A cleaning unit includes a fluid chamber, a fluid intake port, and a fluid exit port. The cleaning unit is attached to the print head such that the fluid chamber surrounds a portion of the print head. A solvent is introduced into the fluid chamber to contact the print head. The solvent is allowed to clean the print head. The solvent is removed from the chamber.

In another aspect, a method of cleaning a print head includes providing a print head assembly. The print head assembly includes a print head. The print head includes an array of nozzles for ejecting droplets of ink, a nozzle face through which the droplets of ink are ejected, a charge electrode adjacent the nozzle face for charging selected droplets of ink, a ground plate opposite the charge electrode and adjacent the nozzle face, and a gutter for collecting droplets ejected form the array of nozzles. The print head cover is removed from the print head assembly. The charge electrode and the ground plate are displaced away from the nozzle face while allowing droplets of ink to be ejected from the array of nozzles. A cleaning unit includes first and second members including a plurality of fluid ejection holes. The cleaning unit is attached to the print head such that the first and second member are configured to eject solvent from the fluid ejection holes onto the nozzle face, gutter, charge electrode, and ground plate of the print head. The solvent is allowed to clean the print head.

In another aspect, a cleaning unit for a binary array printer includes a plurality of fluid chambers. Each fluid chamber is configured to receive a portion of the binary array printer. A fluid spraying device includes a plurality of nozzles and is disposed in each of the fluid chambers and positioned along a substantial length of the fluid chamber to spray fluid on the respective portion of the binary array printer. A fluid exit port is disposed in each of the fluid chambers.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

DETAILED DESCRIPTION

Figure 1:
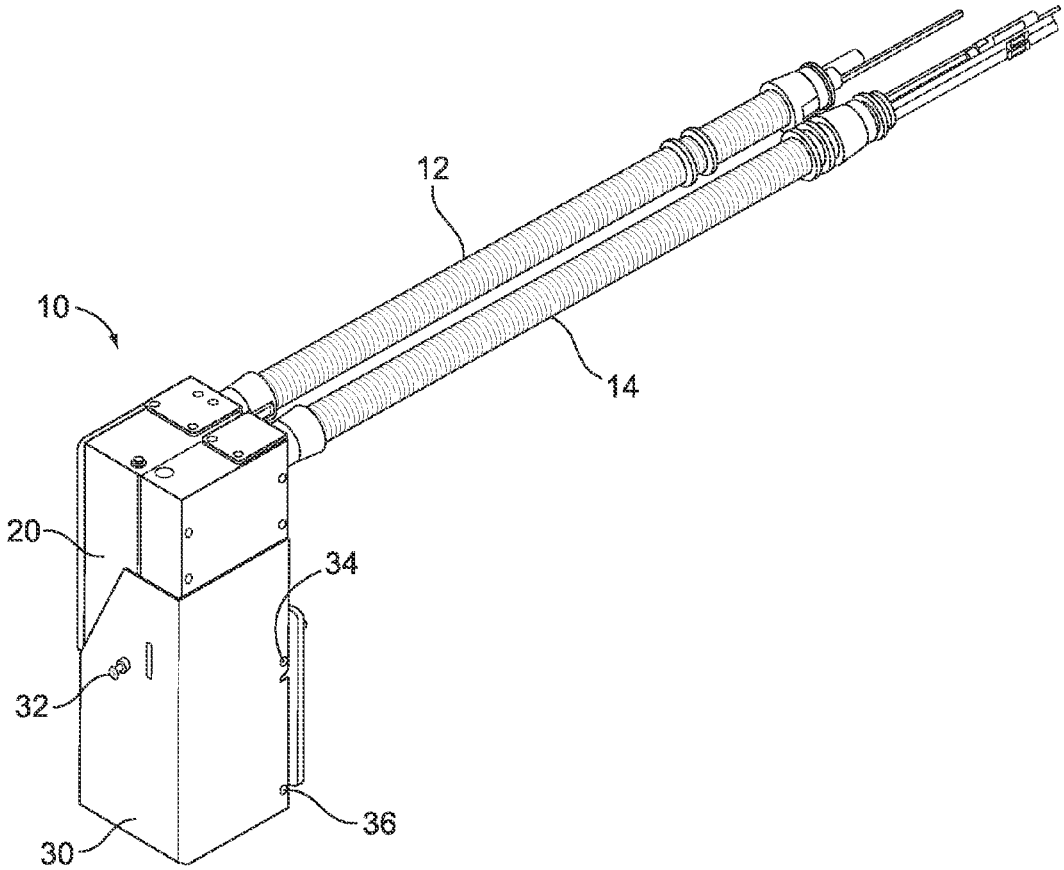
FIG. 1 is a perspective view of an embodiment of a print head assembly.

The invention is described with reference to the drawings in which like elements are referred to by like numerals. The relationship and functioning of the various elements of this invention are better understood by the following detailed description. However, the embodiments of this invention as described below are by way of example only, and the invention is not limited to the embodiments illustrated in the drawings.

The present disclosure provides methods of cleaning a binary array print head to remove contaminants—e.g., either ink, dried ink or other debris. In particular, the methods use cleaning devices that are configured to reduce cleaning procedure variance in the cleaning process by automating some or all of the required operator steps.

FIG. 1 shows an embodiment of a print head assembly 10. Print head assembly 10 includes a print head 20 and a print head cover 30. Conduits 12, 14 may be used to carry fluids and electrical wires to the print head assembly 10. A variety of connectors, such as screws or posts 32, 34, 36 may be used to connect the print head cover 30 to the print head 20. The print head 20 may be a binary array print head, such as a BX printer available from Videojet Technologies Inc., including the Videojet® BX6000 Series (available in single head or dual head configurations). The BX printing system delivers a number of advantages regarding reliability in industrial applications by virtue of its design.

Figure 2:
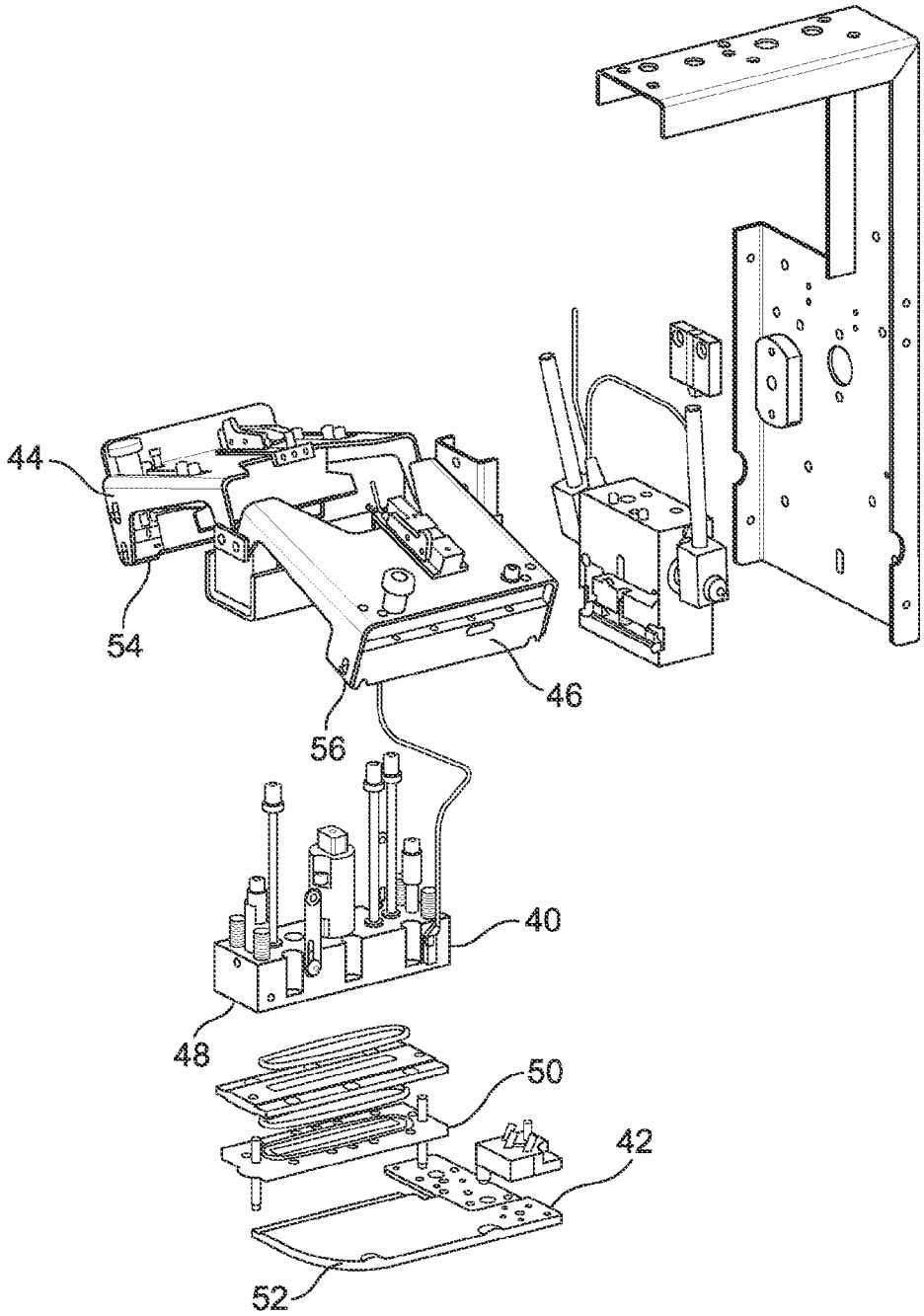
FIG. 2 is an exploded view of the print head assembly of FIG. 1.

FIG. 2 is an exploded view of the print head 20. The print head 20 includes drop generator assembly 40, gutter assembly 42, and swing arms 44, 46. Drop generator assembly 40 includes an array 48 of nozzles for ejecting streams of ink. Adjacent the nozzle array 48 is a nozzle face 50 through which the streams of ink are ejected. A gutter 52 collects droplets of ink ejected from the nozzle array 48. A charge electrode 54 is disposed on arm 44 and, in the closed position, is adjacent the nozzle face 50. The charge electrode 54 charges selected droplets of ink. A ground plate 56 is disposed on arm 46 and is opposite the charge electrode 54 and adjacent the nozzle face 50 when the arms 44, 46 are closed. Also disposed on arm 46, electrically isolated from and above the ground plate, is a jet bias plate.

Figure 3:
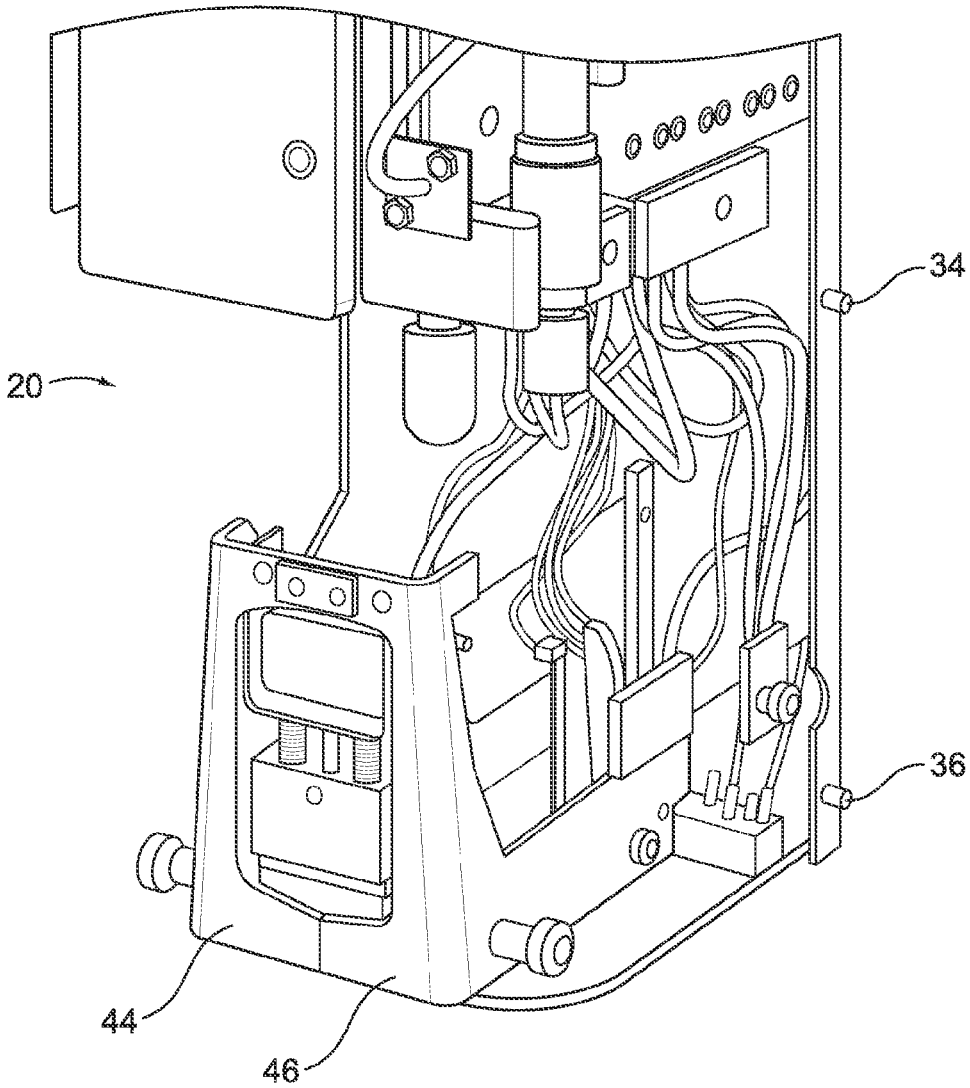
FIG. 3 is a perspective view of the print head assembly of FIG. 1 with the cover removed.
Figure 4:
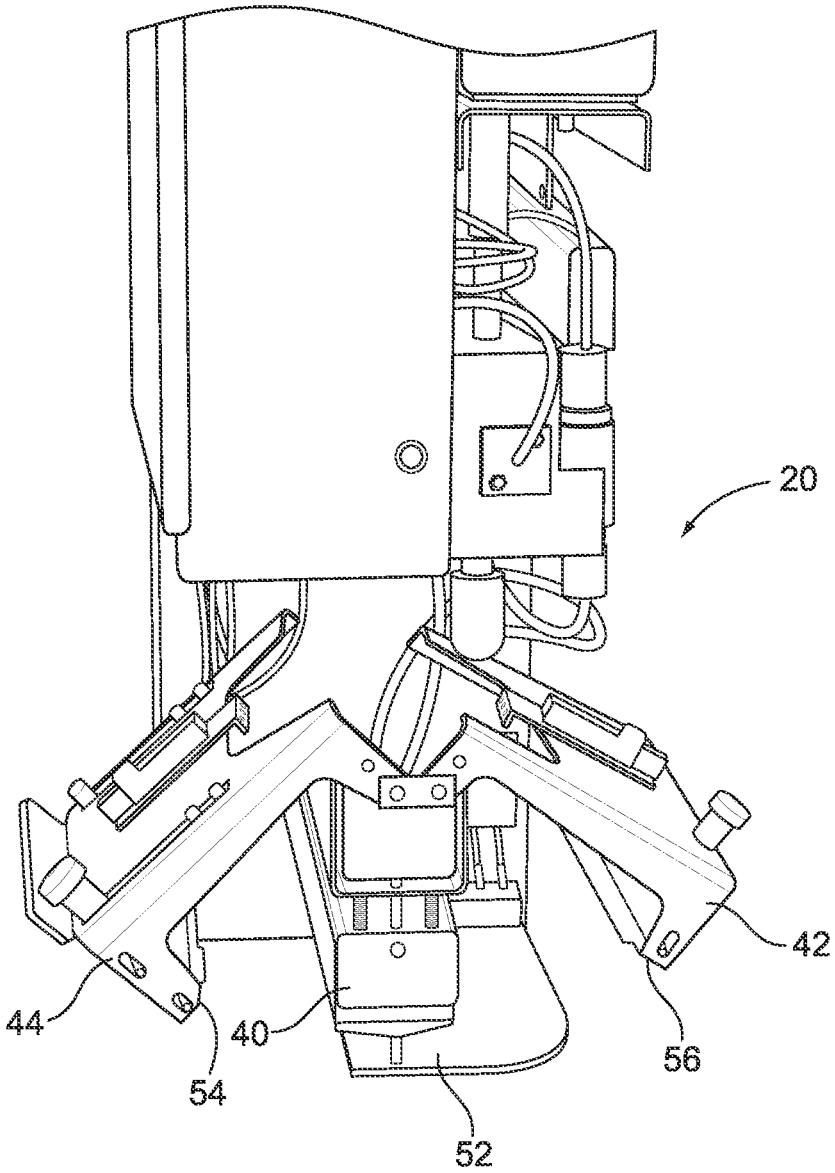
FIG. 4 is a perspective view of the print head assembly of FIG. 3 with the arms open.

The arms 42, 44 are moveable between an open and closed position. FIG. 3 shows the arms 44 and 46 in the closed position. In the open position, as shown in FIG. 4, the arms 42, 44 remove the charge electrode 54 and the ground plate 56 away from the ink stream during startup and maintenance (i.e., cleaning) so that the charge electrode 54 and the ground plate 56 and the nozzle face 50 are easily accessed by the applied cleaning solution.

During operation, ink tends to accumulate at and in the vicinity of the functional surfaces of the print head 20, including the nozzle face 50, the charge electrode 54, the ground plate 56, the jet bias plate, and the gutter 52. It should be noted that the nozzle face 50 is integral with the nozzle orifices (i.e., cleaning the nozzle face 50 may also clean the orifices particularly if the ink streams are not on). It is desirable to regularly remove such accumulation. It is further desirable to do such cleaning with minimal disturbance of the print head 20 and with a high degree of reproducibility such that each cleaning event is consistent and thorough.

Figure 5:
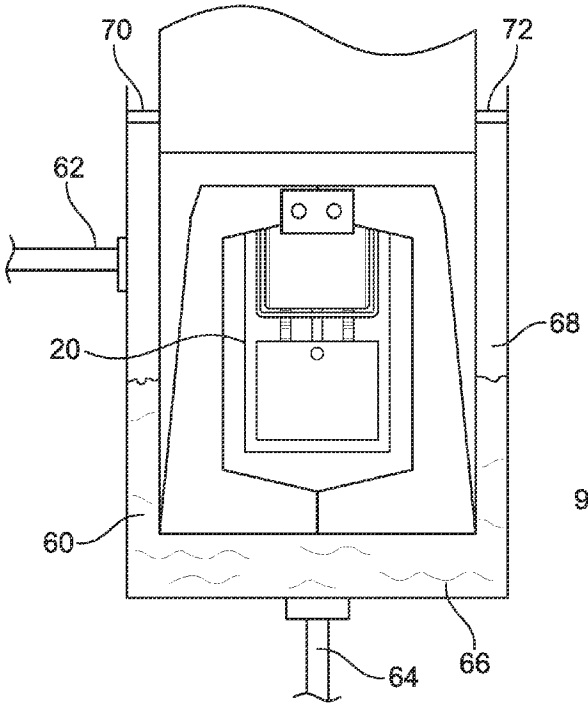
FIG. 5 is a side view of an embodiment of a cleaning unit around a print head.

FIG. 5 shows an embodiment of a cleaning unit 60. The cleaning unit 60 is configured to be disposed around the print head 20. The cleaning unit 60 includes a fluid intake port 62 and a fluid exit port 64. The cleaning unit 60 provides a fluid chamber 68 for holding a cleaning fluid or solvent 66. To clean the print head 20, the print head cover 30 is first removed. The cleaning unit 60 is attached to the print head 20 such that the fluid chamber 68 surrounds the print head 20. The cleaning unit is preferably attached at the same points on the print head 20 as the print head cover 30 is attached to the print head 20. In the embodiment shown in FIG. 5, the cleaning unit 60 is attached to the print head 20 with fasteners 70, 72. However, other means of attachment are possible. It is preferable that the cleaning unit 60 attach to the print head 20 without modifying the print head 20.

A solvent 66 is introduced into the fluid chamber 68 to contact the elements of the print head 20 to facilitate the removal of contaminants. The solvent is left around the print head 20 for a period of time that is effective to clean the components of the print head 20. After the cleaning process is completed, the solvent is removed from the chamber 68, such as by exit port 64. Vacuum suction may be used to remove the solvent from the cleaning unit 60.

It should be noted that a simpler apparatus is also within the scope of the current invention which would simply include a cleaning unit with a static bath that is introduced around print head 20 and allowed to clean the contaminants in the manner as described above. In such an embedment, the fluid ports would not necessarily need to be present to remove the fluid from the chamber. The cleaning unit might also be part of the print head 20. The internal side walls of the print head cover 30 may include the side walls of the fluid chamber and the floor that retains the solvent may, for example be a temporary floor created by a sealable flap, inflatable member, or other temporary barrier that covers over the drop exit slot at the bottom of the cover.

After the solvent is removed from the chamber 68, the components of the print head 20 may be dried. The drying process may be accomplished through providing an air current passing over the print head components using an air source that preferably exhibits controlled water content. A preferred level of moisture or solvent is preferably less than 25 $g/m^3$ and more preferably less than 15 $g/m^3$. The air may furthermore be heated to facilitate the drying. Any air temperature is conceivable up to the flash point of the solvents used in the printer. The air may be provided from the same compressed air source that supplies the printer. The print head may be disposed at any orientation during cleaning to facilitate the natural drainage of the cleaning fluid.

The cleaning process may include one or more cycles of filling the unit with solvent. The multiple cycles may use the same solvent or different solvents. In one embodiment, after a first solvent is drained from the cleaning unit 60, a second solvent and even a third solvent are introduced into the fluid chamber 68 to contact the print head 20 to clean it. After a period time, the second and/or solvents are removed from the chamber 68.

While the components of the print head 20 are immersed in the solvent, the solvent and/or the print head 20 may be agitated to enhance the cleaning of the print head 20. The agitation may be accomplished by mechanically mixing the solvent, such as using a pump, stir bar, impeller, or other device. Alternatively, the solvent may ultrasonically agitated to enhance the cleaning process. The type of mixing, whether mechanical or ultrasonic, should be carefully controlled to prevent damage to the print head 20.

In one embodiment, the print head is soaked in the solvent for a period of at least 10 minutes, 30 minutes, or 60 minutes. The solvent used may be any solvent including water or organic solvent. Examples of possible organic solvents include $C_1$-$C_4$ alcohols, $C_4$-$C_8$ ethers, $C_3$-$C_6$ ketones, $C_3$-$C_6$ esters, and mixtures thereof. Examples of $C_1$-$C_4$ alcohols include methanol, ethanol, 1-propanol, and 2-propanol. Examples of $C_4$-$C_8$ ethers include diethyl ether, dipropyl ether, dibutyl ether and tetrahydrofuran. Examples of $C_3$-$C_6$ ketones include acetone, methyl ethyl ketone and cyclohexanone. Examples of $C_3$-$C_6$ esters include methyl acetate, ethyl acetate and n-butyl acetate. In one embodiment, the solvent is a ketone solvent, such as acetone or methyl ethyl ketone. In another embodiment, the solvent is a blend of ketone and alcohol, such as acetone and ethanol.

In another embodiment, a combination of solvents is used where a first solvent corresponding to the first cleaning cycle is a non-aqueous solvent, a second solvent includes 100% water or an aqueous blend, and a third solvent that is again a non-aqueous solvent. An example of a preferred aqueous blend would for example be 50:50 ethanol:water. In yet another embodiment similar to the previous embodiment, the second solvent includes 100% alcohol such as methyl or ethyl alcohol. Water may be substituted in the embodiment with other solvents exhibiting similar Hansen solubility parameters (polar and protic components) such as nitriles, alkyl sulfoxides, carbonates, formamides, pyrrolidones, or glycols.

Figure 6:
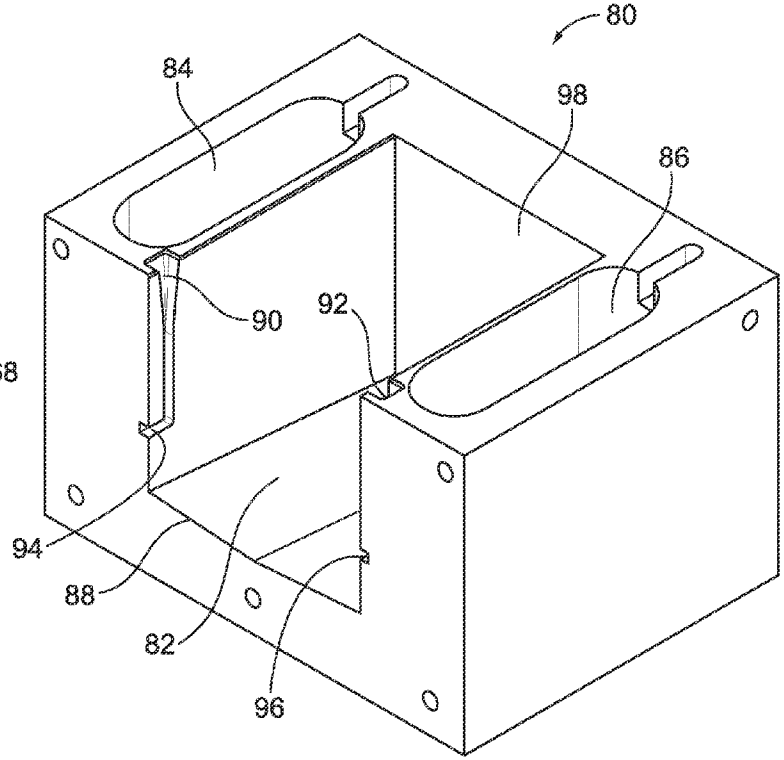
FIG. 6 is a perspective view of another embodiment of a cleaning unit.

FIG. 6 shows a second embodiment of a cleaning unit 80. Cleaning unit 80 includes a plurality of fluid chambers, including a central fluid chamber 82, a first side fluid chamber 84, and a second side fluid chamber 86. The central fluid chamber 82 is disposed between the side fluid chambers 84 and 86. Each fluid chamber 82, 84, 86 is configured to receive a portion of a binary array printer. For example, side chambers 84, 86 may be shaped as elongated ovals but are suitably shaped to surround the appropriate portion if the print head. Central fluid chamber 82 may be generally rectangular in cross section and include an opening or open side 88 to allow the cleaning unit 80 to be easily positioned around the print head 20. Opening 88 may extend a substantial height of the central fluid chamber 82 to aid in positioning the cleaning unit 80 around a print head. Opening 88 is preferably sealed by a cover plate 100 (shown in FIG. 7) after the cleaning unit 80 is disposed around a print head. Cleaning unit 80 may include elongated slots 90, 92 which are adapted to slide onto printer features (such as connectors or posts 36 in FIG. 3) and then allow the printer features to hook into side slots 94, 96. Other suitable connection features known to those skilled in the art are of course possible. Thus, the cleaning unit 80 may be attached to the print head 20 by positioning it underneath the print head 20, moving the cleaning unit 80 upwards with connectors 36 positioned in slots 90, 92, then moving the unit 80 laterally to engage connectors 36 in side slots 94, 96, thus securing the unit 80 to the print head 20. Cover plate 100 is then attached to the cleaning unit 80 to seal the face of central chamber 82.

Figure 7:
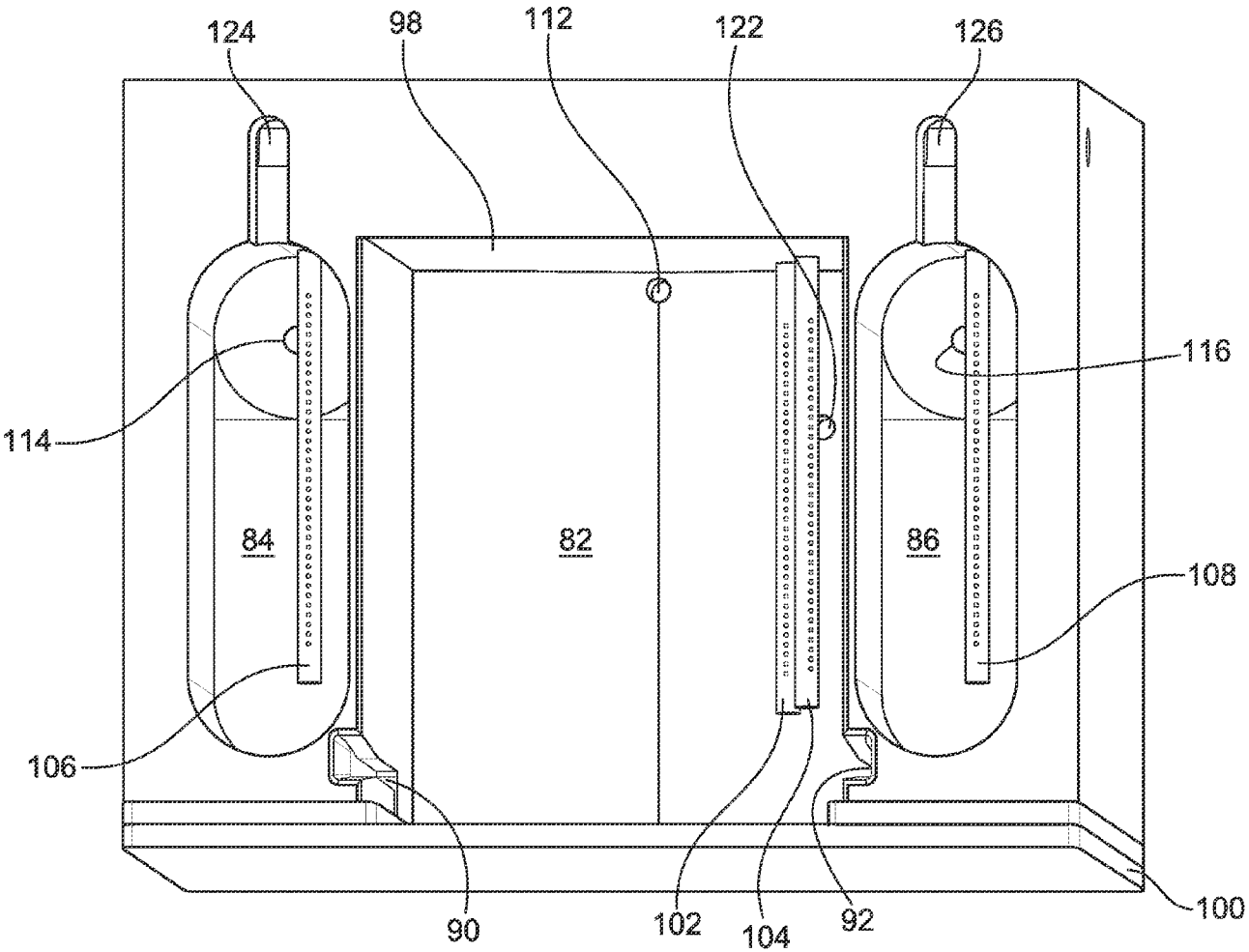
FIG. 7 is a top perspective view of the cleaning unit of FIG. 6.

FIG. 7 is a top perspective view of the cleaning unit 80. Disposed in each of the fluid chambers is one or more fluid spraying devices 102, 104, 106, 108. In the embodiment shown in FIG. 7, fluid spraying devices 102, 104 are disposed in chamber 82, fluid spraying device 106 is disposed in chamber 84, and fluid spraying device 108 is disposed in chamber 86. Each chamber preferably includes an exit port, shown as 112, 114, and 116 in FIG. 7. Some or all of the exit ports may have a graded or conical shape region to ensure that all fluid may be removed from the respective chamber during a drain cycle. Each chamber may also include an overflow drain 122, 124, 126 to provide that the respective chamber 82, 84, 86 will not overflow if the primary exit port 112, 114, 116 becomes blocked or otherwise cannot handle the fluid flow being introduced by the fluid spraying devices.

The fluid spraying devices 102, 104, 106, 108 may be attached to and disposed perpendicular to the respective chamber wall of the cleaning unit 80. For example, devices 102 and 104 extend from back wall 98 of chamber 82. The fluid spraying devices 102, 104, 106, and 108 are generally elongated in shape and may be cylindrical. The fluid spraying devices 102, 104, 106, 108 may extend a substantial length of the respective chamber to allow a majority of the desired surface to be sprayed with solvent. Each fluid spraying device includes a plurality of cleaning nozzles. The cleaning nozzles are configured to spray fluid in one or more directions. The fluid spraying devices may be thought of as similar in configuration to a garden sprinkler. The fluid spraying devices are supplied fluid from ports within the cleaning unit 80 and ultimately from an external source. In one embodiment, the fluid spraying devices may rotate or oscillate around their axes with respect to the wall to enhance the spray from cleaning nozzles. The cleaning fluid delivered may be in the form of a solid stream, a spray of any shape (i.e., flat, conical, etc.), or a mist.

Figure 8:
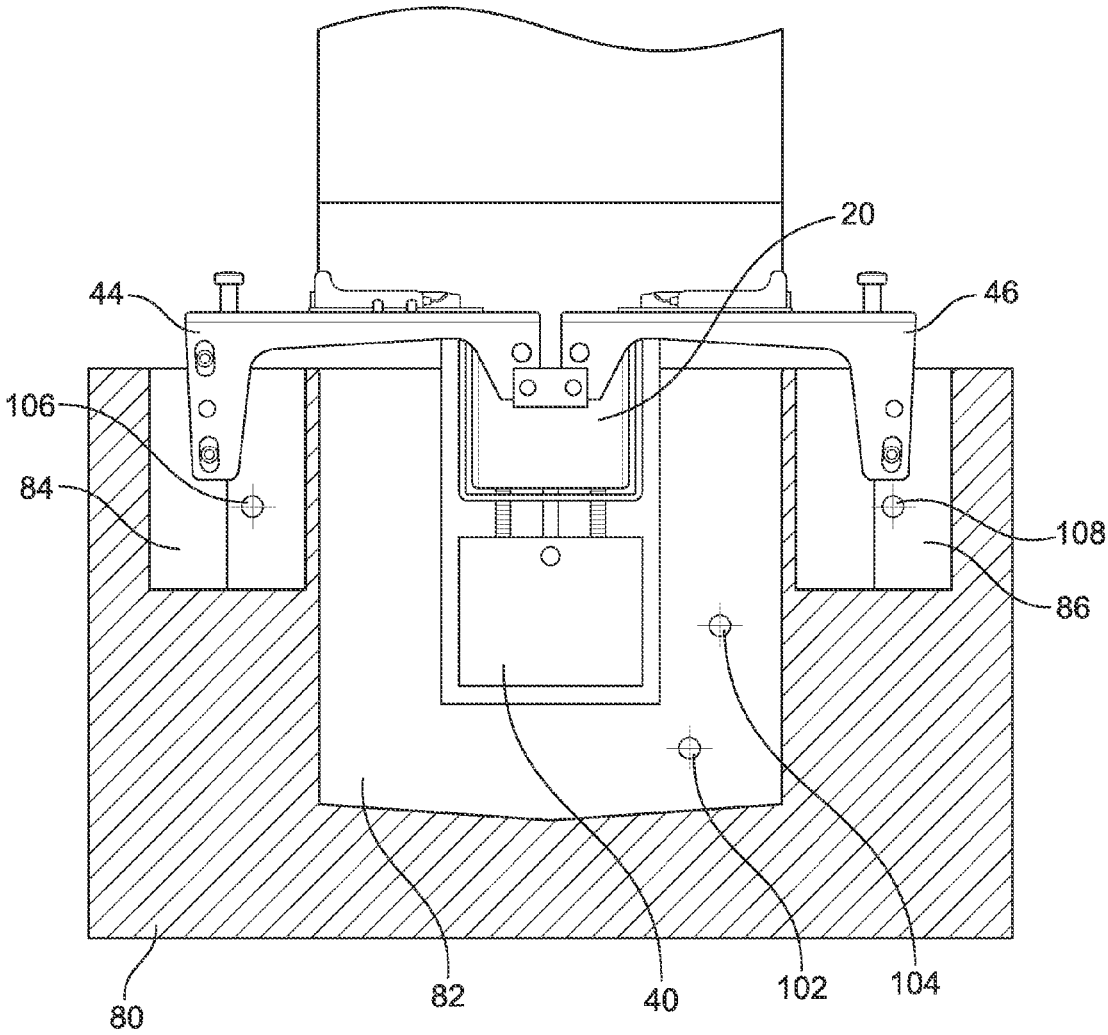
FIG. 8 is a side sectional view of the cleaning unit of FIG. 6 attached to a printer.

As shown in FIG. 8, the cleaning unit 80 is attached to the print head 20 such that the ends of swing arm 46 (including ground plate 56) and swing arm 42 (including charge electrode 54) are disposed in chambers 84 and 86, respectively, and the main body of the print head 20 (including the nozzle face 50 and the gutter 52) is disposed in central chamber 82. The fluid spraying devices 102, 104, 106, and 108 are configured to eject solvent from the cleaning nozzles onto the components (or vicinities thereof), i.e., nozzle face 48, gutter 52, charge electrode 54, and ground plate 56 or jet bias plate of the print head 20 to remove dried ink and any other accumulated debris. The cleaning unit 80 is configured such that spraying devices 102 and 104 are disposed above and below the nozzle face 48 and do not block the path of ink between the nozzle face 48 and the gutter 52. Thus, the printer may continue to eject ink during a portion or all of the cleaning process. This process has advantages over other embodiments in that it requires no printer shut-down or start-up and furthermore requires no modifications to the existing binary array hardware or software. The solvent is sprayed through the spraying devices for a sufficient period of time to clean portions of the print head 20, preferably for a period of at least 1 minute and less than 5 minutes, preferably about 2 minutes. The spraying process may be combined with the previously described soaking process. The solvent is allowed to settle in the bottom of chambers 82, 84, and 86 and is collected through exit ports 112, 114, and 116. After cleaning, the print head 20 may be dried with any method as described above. If compressed air is used for drying, it can be ejected through the spraying devices to dry the print head 20.

It should be noted that other means to achieve the same goals are possible such as by using a single spraying device—either stationary or movable—capable of being disposed at different locations. For example, in one embodiment, the swing arms might reside in their open or closed positions and a single spraying device is introduced at the front of the print head 20 that would wash through the narrow regions around the streams where the nozzle face 48, gutter 52, charge electrode 54, and ground plate 56 or jet bias plate are disposed. In such an embodiment, the jets would be switched over to jet solvents, such as the makeup solvent used by the printer or another solvent, so that when the cleaner is introduced via the cleaning nozzles of the external member, it would not result in an increase in contamination of the functional components by the ink jets. This switching over of jets to solvent instead of ink is routinely accomplished during the printer normal start-up and shutdown orifice cleaning algorithms. This embodiment would avoid the additional step of relocation of the swing arm assemblies to their open/maintenance positions.

In yet another embodiment, the cleaning spray application is timed with a jets-off event or a back-flushing function. A nozzle-off event may be provide by either disengaging the ink pressure by turning off the pump in the ink system or by closing the ink feed solenoid valve in the print head. A back-flush method is currently a used by a printer algorithm whereby the ink feed valve is closed and a negative pressure is applied across the entire nozzle orifice array via a pump, thereby pulling cleaning solution back through the nozzles into the ink system. By coordinating these events with the cleaner spraying events, the cleaner can be applied again without impacting the ink jets resulting that would result in increased contamination due to misdirected ink. A particularly advantageous embodiment is one where a cleaning member is positioned to direct spray across the nozzle face during the backflush event so that the nozzle orifices are cleared of contamination. This would effectively emulate the manual nozzle back-flush method, but would accomplish it again in a more automated and controlled fashion and, again, no active time on the part of the operator. Preferably, a series of different solvents can be employed in an automated backflush method, as described above, which would comprise an organic solvent followed by an aqueous solvent and then again by an organic solvent. An entire cleaning cycle, including back flushing, spraying, and draining, may take less than about 15 minutes, preferably less than about 10 minutes.

The cleaning unit 80 can preferably be attached to the print head 20 and not moved or require any operator action after attachment, such that the cleaning process is essentially automatic and relatively invariant. The attachment of the unit 80 and movement of the internal parts within the print head 20 (e.g., the swing arms to the open/closed positions) may be carried out by any means including manually, robotic arms, or by incorporating further modifications into the print head such as solenoids, actuators, etc.

The solvent used with cleaning unit 80 may be any of the previous listed solvents. The solvent is preferably compatible with the ink used in the printer so that ink sucked into the gutter does not have any performance problems when it is recirculated into the printer. However, any residual cleaning solvent from the automated process that is incidentally introduced into the gutter and thus the printer's ink system may be diverted to a waste stream if desired.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

What is claimed is:

1. A method of cleaning a print head assembly comprising a print head and a cover, wherein the print head comprises:

an array of nozzles for ejecting streams of ink;

a nozzle face containing nozzle orifices through which the streams of ink are ejected;

a charge electrode adjacent the nozzle face for charging selected droplets of ink;

a ground plate opposite the charge electrode and adjacent the nozzle face; and a gutter for collecting droplets ejected from the nozzle array;

wherein the method comprises:

removing the cover from the print head assembly;

providing a cleaning unit, the cleaning unit comprising a fluid chamber;

a fluid intake port; and a fluid exit port;

attaching the cleaning unit to the print head such that the fluid chamber surrounds a portion of the print head;

introducing a solvent into the fluid chamber to contact the print head;

allowing the solvent to clean the print head; and removing the solvent from the chamber.

2. The method of claim 1 wherein the print head is a binary array print head.

3. The method of claim 1 wherein the cleaning unit comprises a fluid spraying device, wherein the method further comprises spraying fluid onto the print head from the fluid spraying device.

4. The method of claim 1 further comprising allowing the solvent to collect in the fluid chamber and soaking the portion of the print head in the solvent.

5. The method of claim 4 wherein the print head is soaked in the solvent for a period of at least 30 minutes.

6. The method of claim 4 further comprising agitating the solvent in the fluid chamber.

7. The method of claim 6 where agitating the solvent comprises ultrasonically mixing the solvent.

8. The method of claim 1 further comprising drying the print head after the solvent is removed.

9. The method of claim 1 wherein the solvent comprises a first solvent, wherein the method further comprises:

introducing a second solvent different from the first solvent during a second cleaning cycle into the fluid chamber to contact the print head;

allowing the second solvent to clean the print head; and removing the second solvent from the chamber.

10. The method of claim 1 wherein the solvent comprises an organic solvent.

11. The method of claim 10 the organic solvent comprises a ketone solvent.

12. The method of claim 1 wherein the solvent comprises an aqueous solvent.

13. The method of claim 1 wherein the fluid chamber is a first fluid chamber, wherein the cleaning unit further comprises a second fluid chamber and a third fluid chamber, wherein the method further comprises, after the step of removing the cover from the print head assembly:

displacing the charge electrode and the ground plate away from the nozzle face;

positioning the nozzle face in the first fluid chamber;

positioning the charge electrode in the second fluid chamber;

positioning the ground plate in the third fluid chamber; and allowing the solvent to clean the print head.

14. The method of claim 1 wherein the cleaning unit comprises at least one fluid spraying device, wherein the method further comprises, after the step of removing the cover from the print head assembly:

displacing the charge electrode and the ground plate away from the nozzle face while allowing streams of ink to be freely ejected from the array of nozzles;

attaching the cleaning unit to the print head such that the fluid spraying device is configured to eject solvent onto the nozzle face, gutter, charge electrode, and ground plate of the print head; and spraying solvent onto the print head to clean the print head.

* * * * *